US010850467B2

(12) United States Patent
Matthes

(10) Patent No.: US 10,850,467 B2
(45) Date of Patent: Dec. 1, 2020

(54) ROTARY PRESS COMPRISING AT LEAST ONE COMPRESSION ROLL STATION MOUNTABLE ON A SUPPORT PLATE, AND METHOD FOR ATTACHING AND DETACHING THE COMPRESSION ROLL STATION

(71) Applicant: Korsch AG, Berlin (DE)

(72) Inventor: Michael Matthes, Dallgow-Döberitz (DE)

(73) Assignee: Korsch AG, Berlin (DE)

( * ) Notice: Subject to any disclaimer, the term of this patent is extended or adjusted under 35 U.S.C. 154(b) by 212 days.

(21) Appl. No.: 15/562,022

(22) PCT Filed: Mar. 29, 2016

(86) PCT No.: PCT/EP2016/056784
§ 371 (c)(1),
(2) Date: Sep. 27, 2017

(87) PCT Pub. No.: WO2016/156306
PCT Pub. Date: Oct. 6, 2016

(65) Prior Publication Data

US 2018/0086017 A1 Mar. 29, 2018

(30) Foreign Application Priority Data

Mar. 27, 2015 (EP) ..... 15161246

(51) Int. Cl.
*B30B 15/02* (2006.01)
*B30B 11/08* (2006.01)

(52) U.S. Cl.
CPC ..... *B30B 15/026* (2013.01); *B30B 11/08* (2013.01)

(58) Field of Classification Search
CPC ..... B30B 15/026; B30B 11/08
See application file for complete search history.

(56) References Cited

FOREIGN PATENT DOCUMENTS

| | | | |
|---|---|---|---|
| CN | 102458815 | A | 5/2012 |
| DE | 197 05 092 | C1 | 3/1998 |
| DE | 197 05 094 | C1 | 7/1998 |
| DE | 10 2009 020 196 | A1 | 11/2010 |
| EP | 2 065 176 | A2 | 6/2009 |
| EP | 2 110 231 | A2 | 10/2009 |
| JP | S63-25296 | U | 2/1988 |
| JP | H01-025765 | Y2 | 8/1989 |

(Continued)

OTHER PUBLICATIONS

Shimada et al. (JP 2003-062608) (Machine translation) (Year: 2003).*

(Continued)

*Primary Examiner* — Robert J Grun
(74) *Attorney, Agent, or Firm* — Wolf, Greenfield & Sacks, P.C.

(57) ABSTRACT

The invention relates to a rotary press comprising at least one compression roll station (1) that can be mounted on a support plate (2) as well as to methods for attaching and detaching the compression roll station. According to the invention, the at least one compression roll station comprises a retaining device (21), and the rotary press comprises a support plate (2) with at least one cavity (22) for accommodating the retaining device (21) of the compression roll station.

9 Claims, 6 Drawing Sheets

(56) References Cited

FOREIGN PATENT DOCUMENTS

Figure 1:
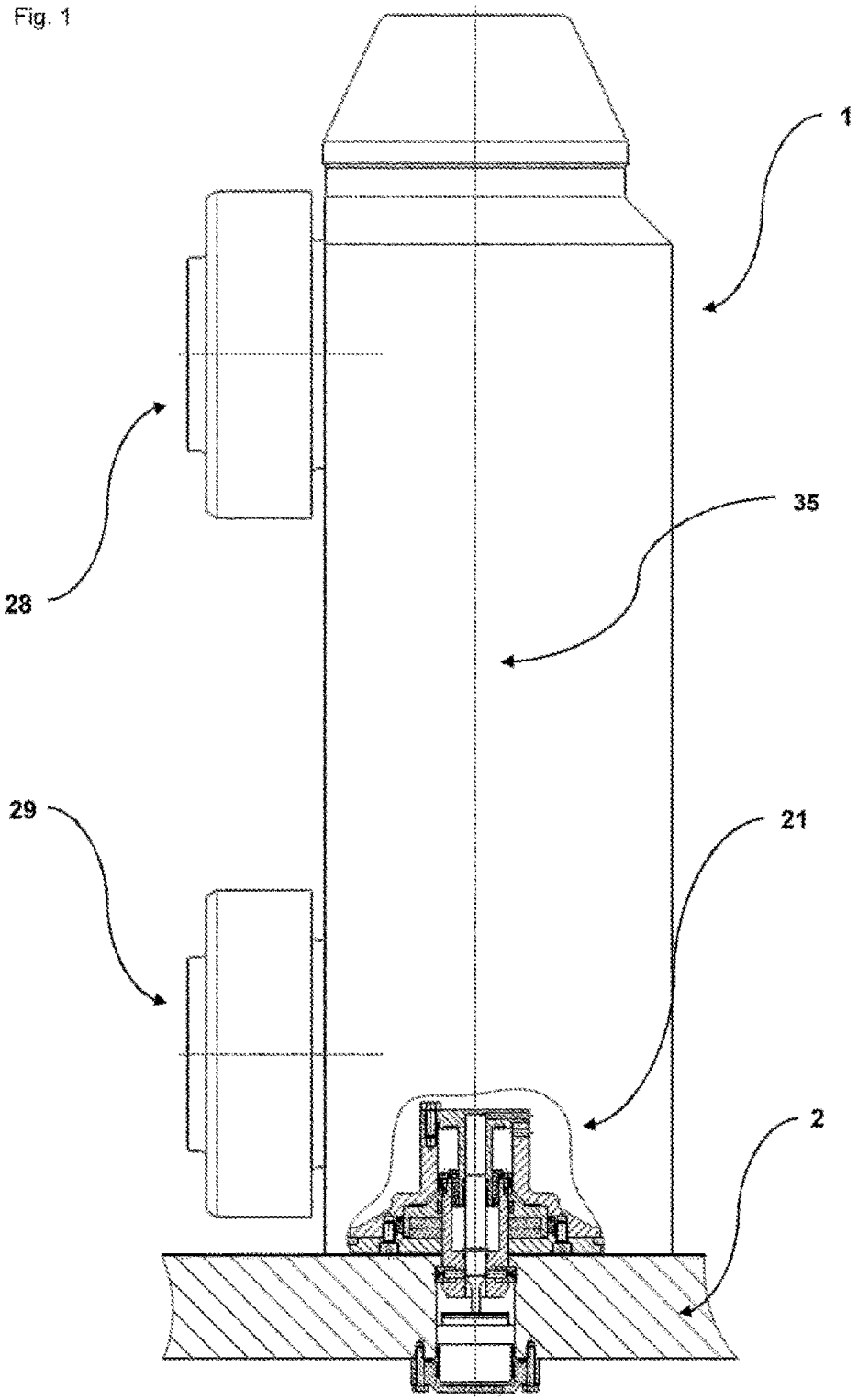

| | | | |
|---|---|---|---|
| JP | H10-216992 | A | 8/1998 |
| JP | 2003-062698 | A | 3/2003 |
| JP | 2009-285673 | A | 12/2009 |
| JP | 2012-525979 | A | 10/2012 |
| KR | 10-1246139 | B1 | 4/2013 |

OTHER PUBLICATIONS

International Search Report for International Application No. PCT/EP2016/056784, dated Jun. 22, 2016.
Written Opinion for International Application No. PCT/EP2016/056784, dated Jun. 22, 2016.
Ch. II International Preliminary Search Report II for International Application No. PCT/EP2016/056784, dated Sep. 12, 2017.
Office Action for Japanese Application No. 2017-550564, dated Oct. 17, 2019.

* cited by examiner

ROTARY PRESS COMPRISING AT LEAST ONE COMPRESSION ROLL STATION MOUNTABLE ON A SUPPORT PLATE, AND METHOD FOR ATTACHING AND DETACHING THE COMPRESSION ROLL STATION

RELATED APPLICATIONS

This application is a national stage filing under 35 U.S.C. § 371 of international PCT application, PCT/EP2016/056784, filed Mar. 29, 2016, which claims priority to European patent application, EP 15161246.2, filed Mar. 27, 2015, each of which is incorporated herein by reference in its entirety.

The invention relates to a rotary press comprising at least one compression roll station mountable on a support plate, and method for attaching and detaching the compression roll station.

It is known that rotary presses comprise a rotatably driven rotor which carries a plurality of stamp pairs, wherein each stamp pair is formed by an upper stamp and a lower stamp which can be adjusted relatively to one another. The rotor comprises a matrix disk in which matrix openings are provided at regular intervals on a circular ring and in which the upper and the lower stamps either cooperate directly or they comprise insert pieces shaped like casings and which are designated as matrices. The material to be processed or, for example, to be pressed to a tablet is filled into these matrices or matrix openings by a filling device. If a stamp pair moves by the rotation of the rotor into the area of the matrix or matrix opening filled in this manner, the two stamps are moved toward one another by control cams and move into the area of a compressing roll station in which they are pressed against one another. As a result, the material in the matrix or in the matrix opening is compressed, for example, to a tablet. After the conclusion of the pressing process, both pressing stamps are moved upward and the tablets are ejected from the matrix opening or the matrix.

The pressing force is transferred according to the method course shown, which is used in particular to produce a so-called single-layer tablet, by the pressure rolls onto the pressing tools, wherein in particular the upper stamp and the lower stamp are designated as pressing tools. For example, rotary presses are known in the prior art in which these pressure rolls are fastened separately from each other, for example, above on the headpiece and below on a support plate in the base of the rotary press. This separate arrangement of the two pressure rolls has the disadvantage that the pressing forces produced during the pressing procedure are transferred directly into the upper as well as into the lower machine housing. The machine housing of the rotatory press consists, for example, of a machine base on which the carrier plate for the lower compression roll is located as well as of a head piece on which the upper compression roll is attached. The headpiece and the machine base are connected to one another, for example, by 2 to 4 corner struts, wherein the headpiece, the corner struts and the support plate in the base of the rotatory press must be manufactured to be very massive and with a high material cost in the separate arrangement of the pressure rolls in order to withstand the pressure forces. This results in a high weight of the rotatory press and in high acquisition costs for a potential purchaser.

Furthermore, it turned out that the machine housing of the rotary presses with a separate positioning of the upper and lower compression roll radiates significant body sound oscillations into the air in the audible range. At rather high speeds of the rotor of the rotary press, sound pressure levels of more than 100 dBA can be produced. These disadvantages are overcome by making available compression roll stations which are in particular suitable for receiving a compression roll pair consisting of an upper and a lower compression roll. Compression roll stations are known in the prior art, for example from the documents DE 197 05 092 C1, DE 197 05 094 C1 and DE 10 2009 020 196 A1.

DE 197 05 092 C1 discloses a compression roll unit for a rotary press, wherein the compression roll unit comprises a frame which can be stopped on the rotary press and which can receive two bearing blocks which for their part receive the compression rolls. The frame is formed from a guide column and the bearing blocks are arranged on upper and lower compression roll receivers which are guided by the guide column and can be adjusted against one another.

DE 197 05 094 C1 discloses a compression roll press which comprises a compression roll unit consisting of a massively constructed guide column with a cylindrical cross section. The compression roll press according to DE 197 05 094 C1 comprises a particular massive bend-resistant and twist-resistant base plate for receiving the rotor, the drive and the compression roll unit, wherein the baseplate is received by an elastic support of a base frame of the rotary press.

In the rotary presses according to DE 197 05 092 C1 and DE 197 05 094 C1 a fastening flange shaped like a truncated cone is fastened inside the lower end of the guide column, wherein a traction anchor is screwed into the fastening flange in which penetrates a neck attachment on the lower end of the fastening flange shaped like a truncated cone which can move inside a an oblong hole introduced into the mass of the baseplate of the rotary tablet press, wherein the cited fastening means is a component of the baseplate. The traction anchor is penetrated underneath the baseplate by a wedge which can be detached by a spindle, wherein these components are constituents of the baseplate.

A rotary press is disclosed in DE 10 2009 020 196 A1 with a compression roll unit which is fastened to a support device, in particular at least to a support plate by a holding device in a detachable manner, wherein the support device comprises several holding devices of the same type. In particular, DE 10 2009 020 196 A1 discloses that the holding devices are constructed in the support plate.

EP 2 065 176 A2 discloses a frame comprising several platforms for receiving and storing different stations of a rotary press and several supports. The supports are attached in pairs to the frame, wherein the frame is fastened on a base platform. The supports are not constructed like columns and do not directly contain the compression roll receptacles but rather surround the entire inner construction of the rotary press like a frame. The base platform is constructed to be less massive than the massive base plates of DE 197 05 092 C1, DE 197 05 094 C1 and DE 10 2009 020 196 A1. The supports are attached to the base platform by lower supports as holding devices, wherein the lower supports are provided with damping elements. The latter are arranged to lie between the base platform and the supports. In particular, no recesses in the thin base platform are disclosed in EP 2 065 176 A2 with which the lower supports cooperate.

EP 2 110 231 discloses a modularly constructed rotary tablet press, wherein individual modules can be changed and/or removed inside the rotary tablet press. The rotary tablet press comprises, for example, two filling stations, two dosing stations and two compression stations, wherein a filling shoe of the filling stations comprises an agitation wing for thoroughly mixing the material to be compressed and finished, pressed tablets are removed by an ejector from the pressing area of the matrix.

The compression roll stations known from the prior art comprise, for example, carrier columns which are present arranged outside of the partial circle of the rotatable rotor of the rotary press. The carrier columns contain guidance and adjustment means in their interior for the upper and the lower compression roll as well as path measuring and pressure measuring systems. The compression rolls are located in a working position of the pressure roll station exactly on a partial rotor circle so that the upper compression roll acts on the upper stamp head and the lower compression roll acts on the lower stamp head. If the rotor with the compression tools is rotating, the latter are drawn by the torque applied by the rotary drive through the upper and the lower compression rolls of the stationary compression roll station, as a result of which the pressing force is transferred from the compression rolls by the stamp heads onto the material to be compressed in the matrix and in this manner a solid tablet is preferably produced from the loose material to be pressed.

Modern rotary presses are distinguished in that starting from a base arrangement for producing single-layer tablets by the addition of appropriate additional modules, a retrofitting of the base press can take place in that even two-layer tablets, three-layer tablets or even jacket core tablets can be pressed. These additional modules can be, for example, compression stations or preliminary pressing stations.

In addition, it turned out that the quality of one-layer tablets can be improved if a ventilation of the material to be pressed takes place in a so-called preliminary pressing station before the actual tablet production by the compressing of the material located in the matrix or in the matrix opening. It turned out that it is desirable for the user of a rotary press that the individual compression stations can be arranged inside the rotary press at different positions and that a more rapid and simpler rearrangement and changing of position of the individual compression stations should be possible in order to ensure a flexible use of the rotary press in different operating states.

It is customary in conventional rotary presses known in the prior art that the carrier plate of the rotary press comprises a plurality of recesses, wherein each of these recesses is equipped with a tightening device with which a compression station can be fastened at the position given by the recess (cf., for example DE 197 05 092 C1, DE 197 05 094 C1 or DE 10 2009 020 196 A1). Furthermore, it is known that such tightening devices present in recesses of a carrier plate are expensive components in a rotary press. It is unsatisfactory in the fastening systems previously known in the prior art that as a rule more tightening devices are present in the carrier plate than actually documented compression station positions. As a consequence, tightening devices are disadvantageously kept which as a rule are not all used at the same time. This unnecessarily makes the so-called multifunctional rotary presses more expensive on account of the greater number of tightening devices in comparison to the visited tightening positions.

Starting from this prior art, the problem of the present invention consists in making available a rotary press and methods for fastening and loosening a compression roll station of a rotary press which does not have the deficiencies and disadvantages of the prior art and in particular make possible an economical, low-maintenance fastening of compression roll stations which are easy to operate at different positions on the carrier plate of a rotary press.

The problem is solved according to the invention by a rotary press, in particular for producing tablets, with at least one compression roll station, wherein the at least one compression roll station comprises a holding device and a carrier plate of the rotary press comprises at least one recess for receiving the holding device of the compression roll station. It was totally surprising that a compression roll station can be made available which comprises a holding device in such a manner that, in particular, only as many holding devices have to be made available for the operation of a rotary press as compression stations used. This is advantageously achieved in that the holding device is a component of the compression roll station and is integrated in it.

In the sense of the present invention the concept "compression roll column" or "compression roll station" denotes one of various station types in the area of rotary tablet presses, in particular those in whose active area the compressing of the usually powdery material to solid pellets, for example, tablets, takes place. Compression roll stations are preferably constructed like columns or have guidance profiles, wherein the columns or profiles used can receive the preferably two compression rolls. It is preferred that the pressing force for producing the pellets is transferred by the compression rolls onto the pressing tools and therefore onto the material to the compressed, wherein in particular the upper stamp and the lower stamp are designated as pressing tools.

It is preferred that compression roll stations are present arranged on a carrier plate of the rotary press, wherein such compression roll stations are known in the prior art which are fastened on the carrier plate by holding devices which are components of the carrier plates. It was completely surprising that a compression roll column can be made available with the present invention which ensures a good stability and an especially reliable operation of the compression roll station, wherein in the compression roll station of the invention the holding device for the fastening on the carrier plate is a component of the compression roll station and is not present inside the carrier plate.

It is preferred that the holding device according to the invention is a tightening device for fixing the compression roll station in recesses in the carrier plate of the rotary press. At least individual components of the holding device or the entire holding device can preferably be moved in a vertical direction along an imaginary central axis inside the compression roll station. As a result, in the sense of the invention a high-and-low movement or an up-and-down movement of the holding device or of its component is preferably carried out. As a result, it is advantageously made available that the holding device can be present, for example, completely or partially inside the compression roll station. If the holding device is completely present inside the compression roll station, the compression roll column is preferably closed flush downwardly so that no components project outwardly. This advantageously makes possible a shifting or a movement of the compression roll station on the carrier plates of the rotary press.

Furthermore, it is preferred that the holding device is present arranged in a production position at least partially in the recesses of the carrier plate. In the sense of this invention a production position is preferably the position in which the compression roll station assumes when the rotary press is operated in order to manufacture, for example, tablets. The holding device lies preferably in a rotor replacement position completely inside the compression roll station, wherein such a position of the compression roll station is designated as the rotor replacement position which the compression roll assumes if a rotor replacement of the rotary press is taking place. It is required for this that compression roll stations can be moved and/or shifted on the carrier plate. This is advantageously achieved in that the holding device of the invention is completely present inside the compression roll station so that advantageously no components of the holding device project out of the compression roll station.

The invention differs from that which was previously technically customary by making available a rotary press in which the holding device for the fastening of the compression roll station on a carrier plate of the rotary press is a component of the compression roll station, because the professional world previously started from the fact that holding devices had to be a component of the carrier plate. It was completely surprising that a compression roll station can be made available which has so much free volume in the lower area facing the carrier plate and a holding device can be received preferably completely inside the lower area of the compression roll station.

Furthermore, it is preferred that the recesses of the carrier plate are formed by openings and/or bores whose diameters correspond to the diameter of the holding device of the compression roll stations. In particular, the recesses are suitable for receiving the holding device of the compression roll station. In the fastening mechanisms known in the prior art for compression roll stations the fastening means, for example, tightening devices, are is a rule inside the recesses within the carrier plate of the rotary press. This is in particular a disadvantage because these tightening devices provided in the carrier plates of the rotary press are expensive to construct and/or require their own media supply lines.

It turned out that the media supplying of the tightening devices, when they are provided inside a compression roll station, surprisingly take place by the already present connections of the compression roll station.

In another preferred embodiment of the invention the holding device comprises locking elements which form in their entirety an annular locking unit with a variable diameter. It is preferred that the locking element preferably comprises 2 to 20 locking units. The selection of this number is not an arbitrary selection but rather corresponds to the result of previous tests which showed that a locking unit with preferably 2 to 20 locking elements is surprisingly especially simple to manufacture and contributes to the stability of the fastening of the compression roll station on the carrier plate which was not to be expected.

It is preferred that the locking elements comprise a circumferential spring. In the tightened state the circumferential spring preferably exerts an inwardly directed force on the locking elements of the locking unit. The direction "inward" preferably means in the sense of the invention that the locking elements are pressed in the direction of a central axis of the compression roll station. This central axis is shown, for example, in FIG. 4. As a consequence, the locking elements are advantageously pressed into a groove which runs around the interior of the holding device and surrounds compression pins by which the movement of an actuation rod is transferred onto the locking elements. This transfer of the movement of an actuating rod and the exertion of the force of the circumferential spring on the locking elements advantageously has the result that the diameter of the locking unit can change. The changeability of the diameter of the locking unit according to the invention surprisingly makes possible an especially stable cooperation of the holding device of the compression roll station with the recesses of the carrier plate, as a result of which not only an innovative type of fastening is made available but a fastening which resists, in comparison to conventional fastening mechanisms, the surprisingly high loads.

It is especially preferred that the individual locking elements can be moved outward by pressure pins which transfer the up-and-down movement of an actuating rod with a variable diameter onto the locking elements so that the diameter of the locking unit is, for example, enlarged. Furthermore, it is preferred that the individual locking elements of the locking unit cooperate in the extended state with projections inside the recesses of the carrier plates of the rotary press, wherein these projections are preferably designed in such a manner that they make possible a reliable fastening of the compression roll station in the extended state of the locking elements. It is preferred in the sense of the invention that these projections are preferably designated as a clamping collar or clamping flange, wherein the cited concepts are used synonymously.

A recess in the carrier plate preferably comprises such a projection in the upper area facing the compression roll station, wherein the projection preferably represents an area of the recess with a reduced diameter. This area can also be preferably designated in the sense of the invention as a narrow position. A locking unit with a variable diameter can surprisingly be made available which has a diameter in the non-tightened state which is smaller than the diameter of the narrow position, as a result of which the holding device can be introduced in a simple and non-complicated manner into the recess in the carrier plate. Furthermore, it was surprising that after the introduction of the holding device into the recess the diameter of the locking element can be increased by the cooperation of an actuation rod with the locking elements in such a manner that the holding device can no longer be removed, for example, by being pulled upward out of the recess of the carrier plate.

In particular, a stable tightening of the individual locking elements on the inner walls of the recess of the carrier plate is ensured by the preferred enlargement of the diameter of the locking element, as a result of which an especially stable fixing of the compression roll station inside the recess of the carrier plate is achieved which acts in several spatial directions.

In another preferred embodiment of the invention the locking unit is designed to be adjustable in height, wherein the ability to be adjusted in height can be realized by an actuating rod which is arranged in the middle or centrally in the annular locking unit. "Adjustable in height" means in the sense of this invention that the locking unit is designed to be movable in particular in the vertical direction and can be moved up or down. The spatial direction "down" stands in the sense of this invention from the perspective of the compression roll station preferably for a movement of the locking unit in the direction of the carrier plate of the rotary press when the compression roll station is present arranged in a customary manner on the carrier plate of the rotary press. Such a movement is preferably designated in the sense of this invention as a "downward movement" of the locking unit or of the actuating rod. It is especially preferred that the locking unit moves into the recesses of the carrier plate by a downward movement of the holding device.

The spatial direction "upward" preferably designates in the sense of this invention an upward movement of the holding device into the inner space of the compression roll station, that is, preferably in the direction of the compression rolls preferably belonging to the compression roll station. This is especially true when the holding device is present in the recesses of the carrier plate. The movement of the locking unit, that is, its ability to be adjusted in height, is preferably achieved with an actuating rod. The previous comments regarding the spatial directions preferably refer to the compression roll station. It is preferred that from the perspective of the carrier plate the spatial direction "upward" is characterized by a movement in the direction of the compression roll station and/or of the rotary press. Therefore, the upper side of the carrier plates preferably faces the rotary press and the compression roll station.

It is preferred that the actuating rod is arranged in the middle or centrally in the compression roll station. "In the middle" means in the sense of this invention that the actuating shaft is arranged substantially axially symmetrical to a central axis of the compression roll station, wherein the concept "substantially" is not unclear for the average person skilled in the art because he knows that compression roll stations have as a rule a rectangular or circular base surface, wherein a symmetrical axis can be determined in the middle for such basic shapes.

In another preferred embodiment of the invention the activating rod has a diameter which tapers to the bottom end of the activating rod. It is preferred that the actuating rod comprises an upper and a lower area, wherein the upper area has in particular a circular base surface which corresponds to the inside diameter of a compression roll station. It is preferable that the inner area of the compression roll station, which preferably serves to receive the actuating rod and whose diameter preferably corresponds to the diameter of the actuating rod, is preferably formed by a hydraulic cylinder, wherein this hydraulic cylinder preferably comprises a bipartite piston consisting of an inner and of an outer piston. The movement of the actuating rod is preferably realized by at least this hydraulic connection.

Furthermore, it is preferable that the actuating rod consists of a lower area which consists at first of a tapering area and merges at the lower end of the activating rod into an area with a constant radius, wherein this constant radius of the lower area is smaller than the diameter of the actuating rod in the upper area. The design and the shape of actuating rod result in particular from the figures representing the invention.

Figure 2:
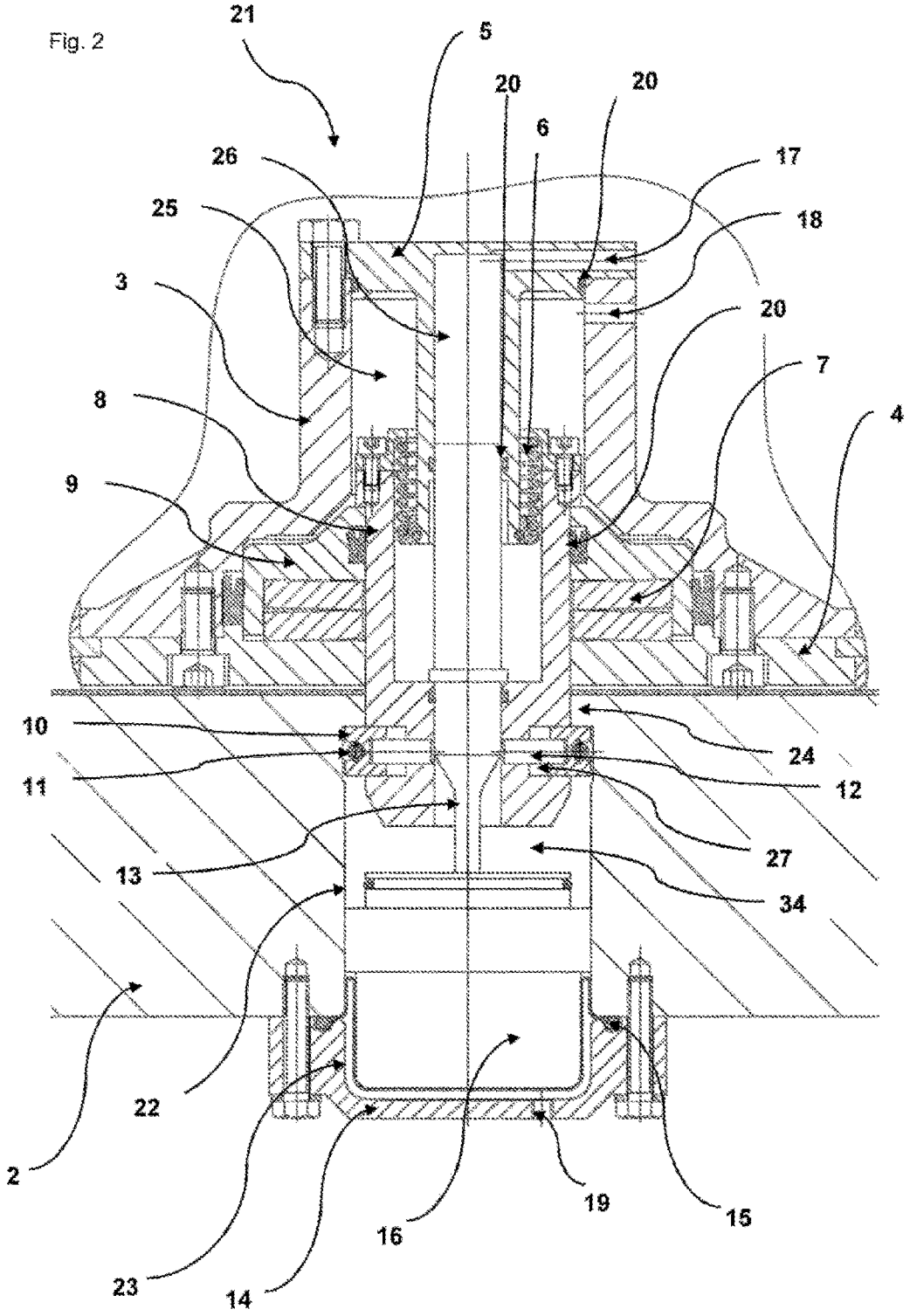

In another embodiment of the invention the diameter of the locking unit is maximum in a first position in minimum in a second position, wherein the diameter of the locking unit can be varied by an activating rod. As can be seen in FIG. 2, the locking elements of the locking unit are pressed outward by the activating rod. This preferably takes place when the area of the activating rod is in contact with the locking elements, which area has the greatest diameter of the actuating rod. The activating rod preferably cooperates with pressure pins which press the locking elements of the locking unit outward. If this takes place, for example, inside the recesses of the carrier plate, in particular in a lower area of the recesses below a projection or a clamping collar, an effective fastening in the sense of a clamping and/or tightening is ensured. This position is preferably designated in the sense of the present invention as the first position or spread position of the locking unit.

A so-called "unlocked" state is preferably characterized in that the actuating rod is preferably also pressed vertically upward by the upward movement of a pneumatic piston, as a result of which an unlocking of the locking elements is achieved. It is preferable if the locking elements also engage in the unlocked state into the projection of the recess of the carrier plate. The unlocked state is shown, for example, in FIG. 3.

The locking elements are preferably relieved by a preferably graduated raising of the actuating rod. For example, it is provided in the first position that the pressure which the locking elements exert, for example, on the inner wall of the recesses in the carrier plate is reduced. In this position the compression roll station can be advantageously rotated about its own axis, wherein a shifting or removal of the compression roll station from the recess can be effectively prevented, for example, in that the locking unit continues to be located below a clamping collar in the recess of the carrier plate. As a result, an undesired sliding off or an undesired change of position of the compression roll station on the carrier plate is surprisingly completely excluded.

Figure 4:
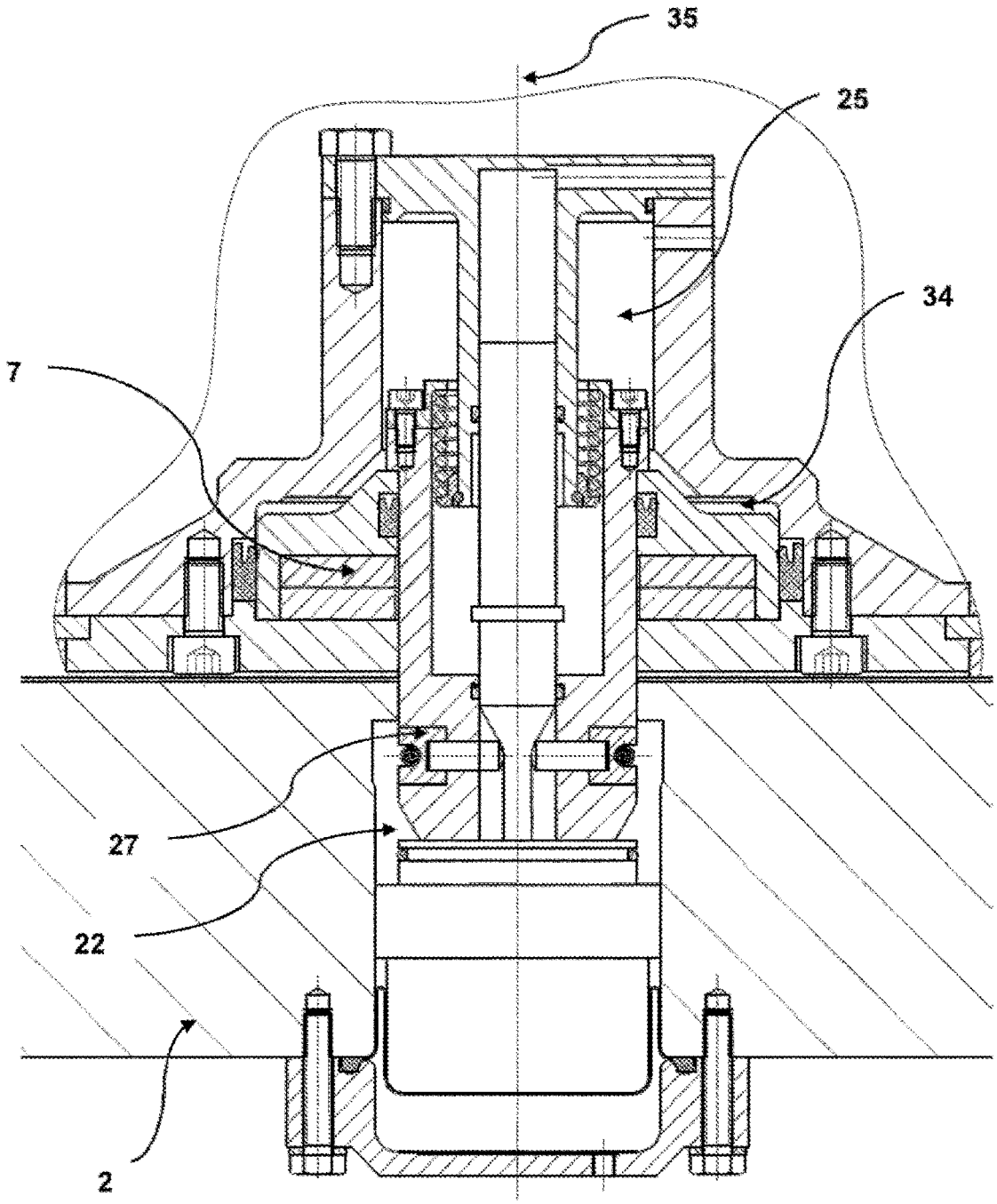

A second position in the sense of this invention is preferably present after an upward movement of the actuating rod if the area of the actuating rod is present at the level of the pressure pins which are arranged between the locking elements and the actuating rod, which area has a reduced diameter in comparison to the upper area of the actuating rod. It is preferable that in this second position no direct contact is given between the actuating rod and the pressure pins of the locking elements so that the locking elements are preferably no longer pressed onto the inner walls of the recesses. It is especially preferred that in this position the locking elements are released and pressed by the spring power of the circumferential spring into a position with a minimum diameter. This position is preferably designated in the sense of the present invention as the second position or "released" position of the locking unit. Tests have shown that the compression roll station in this position can move the holding device of the invention in a surprisingly simple manner and without undesired mechanical contacts out of the recesses of the carrier plate. This is advantageously possible because the locking unit in the release state has its minimum diameter which corresponds in particular to the diameter of the narrow position formed by the projection. This state of the locking unit with minimum diameter is preferably designated as the released state and is shown in FIG. 4.

In another embodiment of the invention the locking elements of the locking unit lie pressed in the first position on an inside wall of the recess of the carrier plate. It is preferable that the inside walls of the recess are formed by a straight wall. In the first position or spread position of the locking elements the fastening of the compression roll station preferably takes place by the spreading pressure which the locking elements exert on the inner wall of the recess. However, it can also be preferred that the inner wall of the recess is provided, for example with a projection, wherein the inside diameter of the recess in the area of this projection is smaller than in the remaining area of the recess and this projection is also preferably designated in the sense of the invention as a clamping collar or clamping flange. It was completely surprising that an effective fastening of the compression roll station inside the recess is made possible by providing projections inside the recesses.

In another preferred embodiment of the invention the diameter of the locking unit in the second position is smaller than the diameter of the recesses of the carrier plate. It is preferred that the locking elements leave the spread position (first position) based on the spring force exerted by the circumferential spring. As a result, the diameter of the locking unit is advantageously reduced and the locking elements are no longer in contact with the inner wall of the recess. In another preferred embodiment of the invention the holding device is completely present inside the compression roll station. It is preferred that this position is described in the sense of the invention as the "rotor replacement position". The holding device preferably does not project past the lower closure of the compression roll station, as a result of which the ability to shift and pivot the compression roll station is advantageously ensured. It was completely surprising that a holding device with a locking unit can be designed to be so compact that it can be completely received by the compression roll station and closes flush in the lower area with the compression roll station. This is advantageously achieved by the cooperation and intermeshing of the components of the holding device with the receiving compression roll station, which brings it about that the holding device can be introduced into the limited available space in the compression roll station.

In another preferred embodiment of the invention the movement of the actuating rod takes place hydraulically, pneumatically, mechanically and/or electromechanically. A hydraulic movement can, for example, be transferred by a hydraulic cylinder, wherein a hydraulic cylinder in the sense of the invention is preferably a working cylinder operated with liquid. It is preferred that in the hydraulic cylinder the energy from the hydraulic liquid which is supplied from a hydraulic pressure storage or a hydraulic pump is converted into a readily controllable force acting in a straight line.

A pneumatic cylinder in the sense of the invention is preferably a working cylinder operated by compressed air which is preferably used to pneumatically move the actuating rod. Electrical cylinders are in the sense of the invention preferably adjusting units which are operated by electromotor in which can move a push tube in and out in a linear manner. It is preferred that the drive of an electrical cylinder takes place by an electromotor which is preferably coupled to a transmission. The moving in and out of the push tube preferably takes place by the right-handed rotation or left-handed rotation of the motor. An electrical cylinder can preferably also be provided with a standing tube for guiding and stabilizing the push tube. Electric cylinders are preferably suited for forces of attraction and/or of pressure.

It is advantageous when using the cited cylinder types that their components can be combined in a surprisingly compact manner. Furthermore, the cited cylinders can be integrated into the total construction of the compression roll station in a surprisingly space-saving manner.

It is preferred in the sense of the invention that the movement of the movable components of the holding device is realized by a first and a second hydraulic connection and a pneumatic connection, wherein the pneumatic connection is preferably arranged in the carrier plate of the rotary press. It is preferred that the diameter of the locking unit is then advantageously reduced when the actuating rod is moved upward by the pneumatic connection and the locking elements are no longer held in the spread position. Furthermore, it is preferred that the holding device comprises a hydraulic cylinder with a cylinder bottom and a cylinder cover, wherein the cylinder bottom of the hydraulic cylinder forms the upper closure of the of the holding device, which closure faces the compression roll station, and the cylinder cover closes the compression roll station downward on the side facing the carrier plate.

Furthermore, it is preferred that the holding device comprises a bipartite piston consisting of an inner piston and an outer piston, wherein the inner piston comprises the locking elements, which form in their entirety the circular locking unit with a variable diameter. It is furthermore preferred that the inner piston, the outer piston and the actuating rod of the holding device are constructed to be movable and that the movement of the movable components of the holding device takes place by a first and a second hydraulic connection and a pneumatic connection. It is furthermore preferred that the cylinder bottom comprises a guide for the actuating rod.

Furthermore, it is provided in a preferred embodiment that the holding device comprises at least one pressure spring arranged between the inner and the outer piston and which is capable, on account of the exerted spring pressure, of reducing the diameter of the locking unit in a surprising manner. As a result, the complete receiving of the holding device inside the compression roll station is advantageously made possible. It is furthermore preferred that the holding device comprises plate springs, as a result a non-positive connection of the locking elements to the inner wall of the recess of the carrier plate is achieved.

In another aspect the invention relates to a method for fastening a compression roll station of a rotary press comprising the following steps:

a) Making a compression roll station available for a rotary press, wherein the compression roll station comprises a holding device with a locking unit consisting of locking elements and with a variable diameter, wherein the locking unit is designed to be adjustable in height and the holding device is present at first in the interior of the compression roll station;
b) Bringing the compression roll station cited in a) in contact with a recess of a carrier plate of the rotary press;
c) Introduction of the holding device into the recess of the carrier plate of the rotary press;
d) Fastening of the compression roll station in the recess of the carrier plate of the rotary press by a downward movement of an actuating rod with a diameter which tapers in a lower area.

After the termination of this method the locking elements of the locking unit are present in a spread position, wherein the locking elements are pressed against the inner walls of the recesses.

In another aspect the invention relates to a method for loosening a compression roll station of a rotary press, comprising the following steps:

a) Making a compression roll station available which is fastened in a recess of a carrier plate of a rotary press, wherein the fastening takes place by a height-adjustable locking unit consisting of locking elements and whose diameter can be adjusted by an actuating rod;
b) Loosening the compression roll station by an upward movement of the actuating rod, as a result of which the spread position of the locking elements is unlocked,
c) An upward movement of the locking unit by another upward movement of the actuating rod so that the holding device is in a rotor replacement position completely inside a compression roll station.

The invention is described in detail using preferred exemplary embodiments and the following figures. In particular, the FIGS. 1 to 6 show a rotary press with a compression roll station comprising a holding device, wherein the movement of the actuating rod and the operation of the locking unit takes place a bipartite hydraulic cylinder in the lower area of the compression roll station and by a pneumatic cylinder in the recess of the carrier plate.

Figure 3:
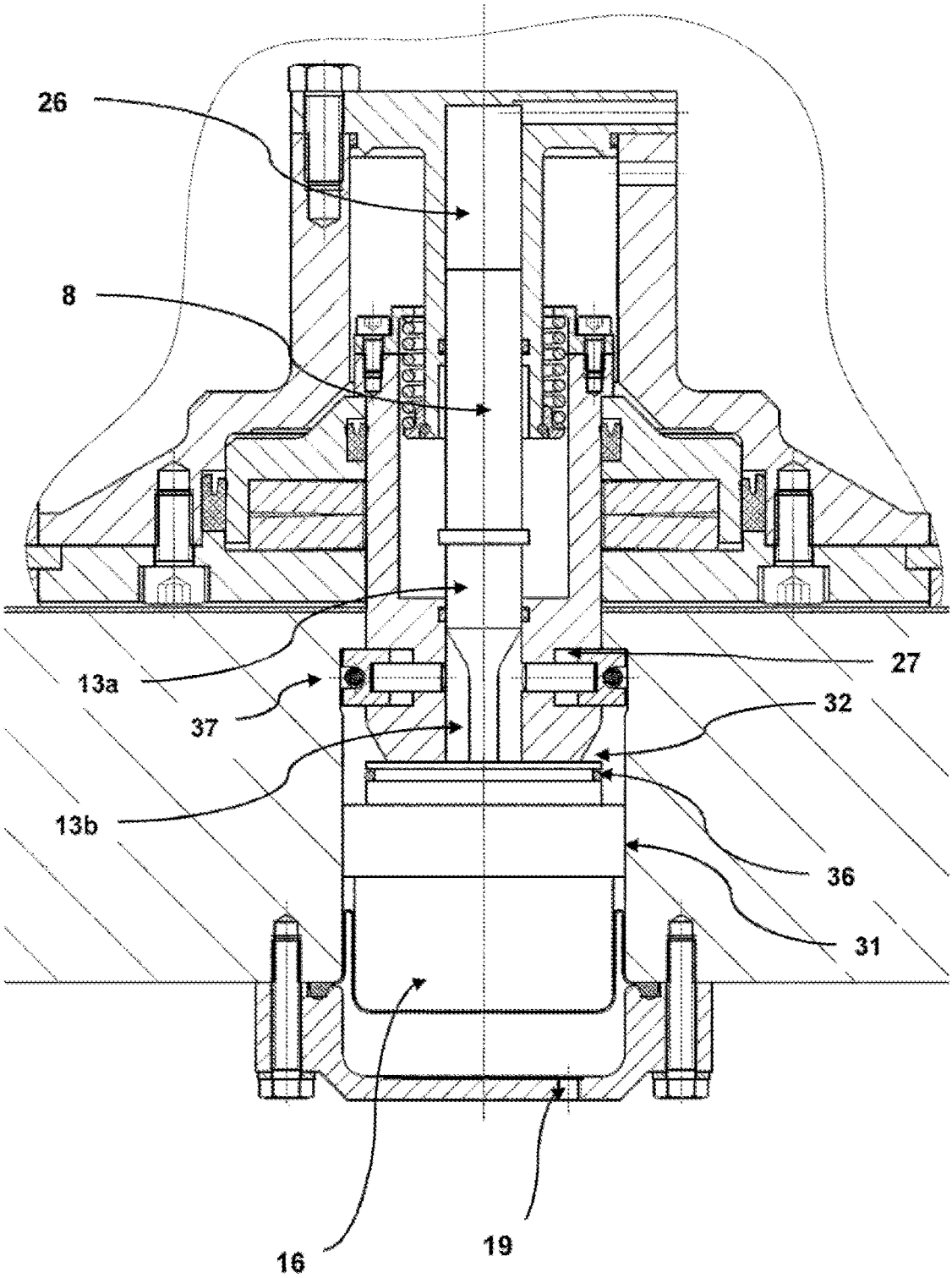
Figure 5:
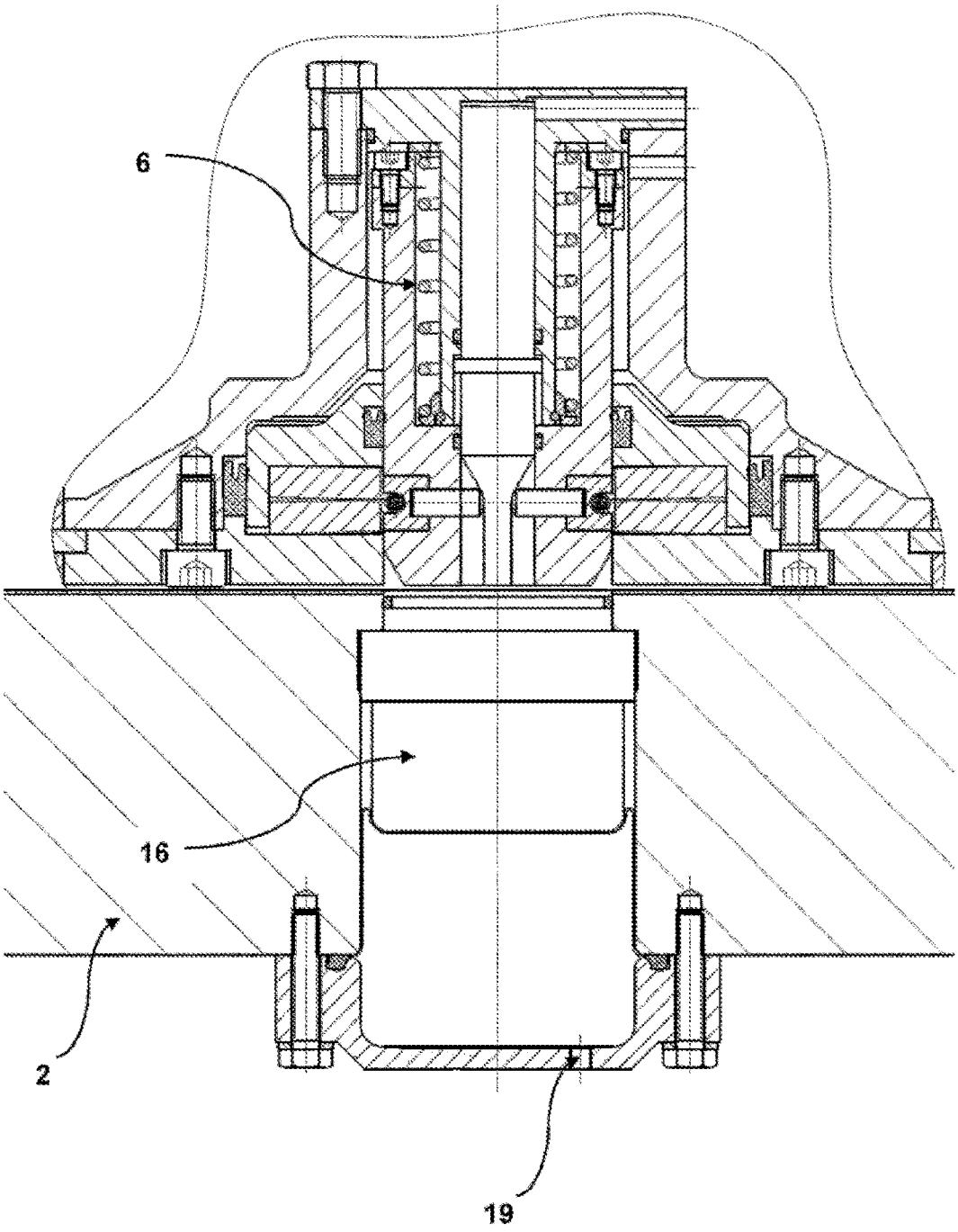
Figure 6:
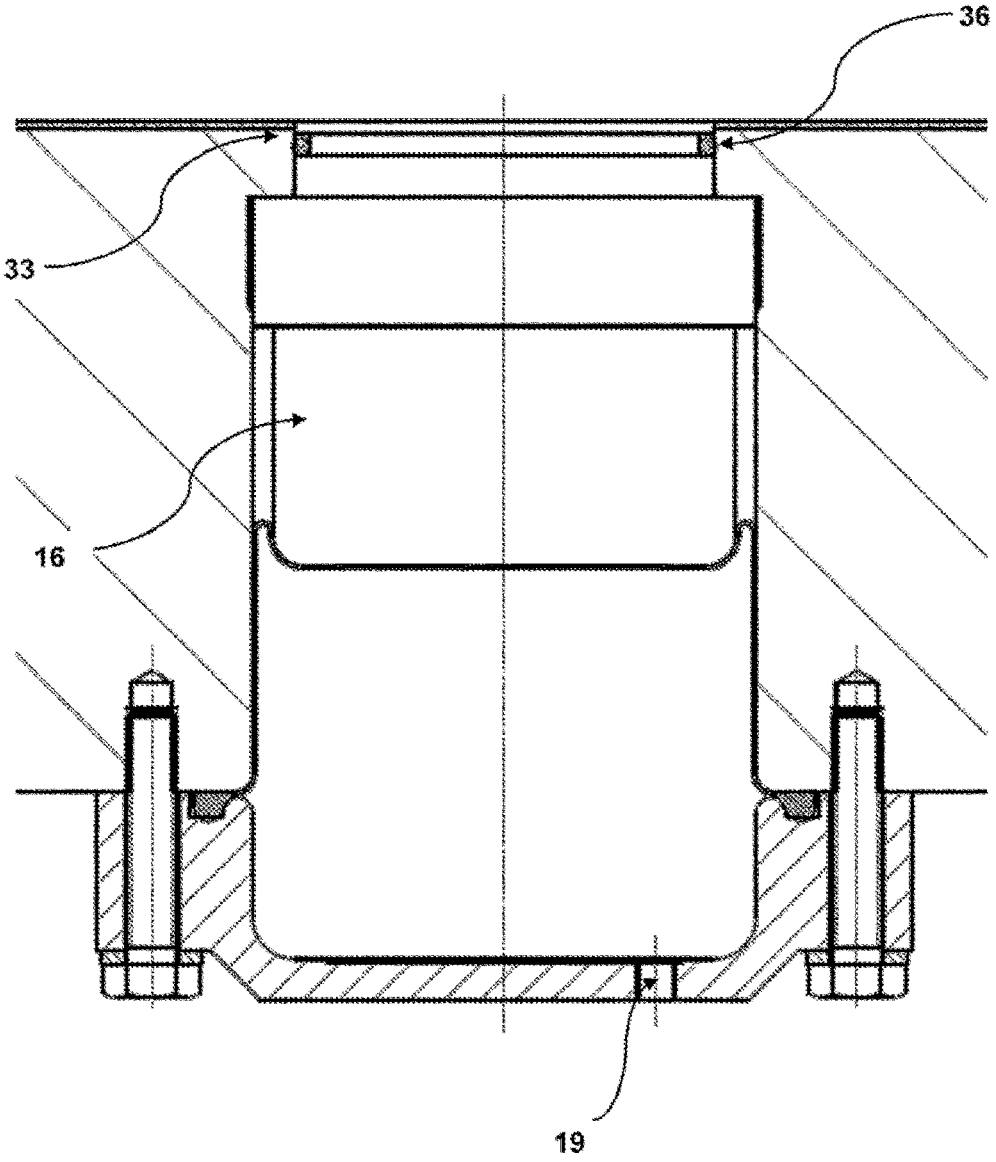

FIG. 1 shows a side view of a preferred embodiment of a compression roll station with a holding device according to the invention, FIG. 2 shows an enlarged side view of a preferred embodiment of a holding device according to the invention, FIG. 3 shows a side view of a preferred embodiment of the holding device according to the invention with a representation of a first step for loosening a spread position of the locking elements, FIG. 4 shows a preferred embodiment of the holding device according to the invention in the loosened state, FIG. 5 shows a preferred embodiment of the holding device according to the invention in a rotor replacement position, and FIG. 6 shows a side view of a preferred embodiment of the pneumatic cylinder in the carrier plate in its rest position.

FIG. 1 shows a side view of a compression roll station (1) as component of a rotary press with an upper (25) and a lower pressure roll (26) by which the pressing forces for manufacturing, for example, a tablet are transferred onto the pressing tools. Furthermore, FIG. 1 shows a carrier plate (2) of the rotary press on which the compression roll station (1) is arranged. The fastening of the compression roll station (1) to the carrier plate (2) takes place by a holding device (21) whose construction and functioning are shown in the other figures. In addition, FIG. 1 shows a central axis (35) in the central position in the interior of the compression roll station (1) of the rotary press.

FIG. 2 shows an enlarged side view of a holding device (21) according to the invention which is arranged on a carrier plate (2) of a rotary press. FIG. 2 shows in particular a first position of the locking elements (10) which is preferably also designated as the spread position. The locking elements (10) lie in a piston bore (22) inside the carrier plate (2) of the rotary press in a clamped manner, wherein this piston bore (22) is also preferably designated in the sense of the invention as a recess. The locking elements (10) together form a locking unit (37). An inner piston (8) of a bipartite hydraulic cylinder (3) is pressed upward by a plate spring packet (7), as a result of which the locking elements (10) are pressed against the lower shoulder of a clamping collar (24) or projection inside the recess (22) of the carrier plate (2). The force of the plate spring packet (7) is preferably transferred by an actuating rod (13) to pressure pins (12) which cooperate with the locking elements (10) of the locking unit (37). The actuating rod (13) comprises an upper area (13 *a*) and a lower area (13 *b*), wherein the diameter of the upper area (13 *a*) corresponds to the diameter of the inner area of the compression roll station (1). The diameter of the upper area (13 *a*) is in particular greater than the diameter of the lower area (13 *b*) of the actuating rod (13). The lower area (13 *b*) of the actuating rod (13) is formed by a tapering area starting from the upper area (13 *a*) and by a lowest area with a constant diameter. In FIG. 2 the pressure pins (12) are in contact with the upper area (13 *a*) of the actuating rod (13). The pressure pins (12) are pressed outward as a result, which presses the locking elements (10) of the locking unit (37) against the inner wall (31) of the recess (22) in the carrier plate (2). In the exemplary embodiment of the invention shown in FIG. 2 the movement of the actuating rod (13) takes place by a pneumatic piston (16) present in a bottom area of the piston bore (22). The pneumatic piston (16) comprises a pneumatic connection (19) and is surrounded by a pneumatic cylinder (14) and the compressed air chamber (23). This compressed air chamber (23) can be filled with compressed air when the pneumatic connection (19) is open. The pneumatic piston (16) is attached by fastening means to the bottom of the carrier plate (2) and furthermore comprises a sealing sleeve (15) which tightly closes the compressed air chamber (23).

As FIG. 2 shows, there is a contact between the lower area (13 *b*) of the actuating rod (13) and the upper area of the pneumatic piston (16). It can also be clearly seen that in this arrangement between the lower closure (32) of the holding device (21) and the upper area of the pneumatic piston (16) there is a free space (30) inside the recess (22) of the carrier plate (2). In the position of the pneumatic piston (16) shown in FIG. 2 the pneumatic connection (19) is not loaded with compressed air.

The locking elements (10) are provided with a circumferential annular spring (11) which exerts a spring force on the locking elements (10). This spring force is directed in particular inward, that is, for example in the direction of the actuating rod (13) centrally arranged inside the compression roll station (1). The spring force has the result that the locking elements (10) move inward, as a result of which the diameter of the locking unit (37) is reduced when the pressure pins (12) are not pressed outward by an actuating rod (13). FIG. 2 shows in particular the locking unit (37) which has its maximum diameter in the spread position. This maximum diameter is in particular greater than the inside diameter of a clamping collar (24) which is also designated as a projection or clamping flange and forms the upper area of the recess (22) of the carrier plate (2).

The upper closure of the holding device (21) is formed by a cylinder bottom (5). The upper area of the holding device (21), which is not designed to be movable and is in the lower area of a compression roll station (1), comprises hydraulic connections (17, 18) which cooperate with different hydraulic pistons (8, 9). These two hydraulic pistons (8, 9) form an inner (8) and an outer piston (9) of a bipartite hydraulic cylinder (3). Pressure springs (6) are arranged in the transition area between the hydraulic pistons (8, 9). The hydraulic pistons (8, 9) can be moved by the hydraulic connections (17 and 18). The hydraulic cylinder (3) comprises a cylinder cover (4) as the lower closure of the compression roll station (1) and comprises a cylinder bottom (5) as the upper closure of the holding device. Seals (20) close the various work areas inside the hydraulic cylinder (3) against each other.

FIG. 3 shows a side view of the holding device (21) of the invention, in particular a first step for loosening the spread position of the locking elements (10), with which the fastening of the compression roll station (1) inside the recess (22) of the carrier plate (2) of the rotary press is ensured. In order to loosen the spread position, the compressed air connection (19) is loaded with compressed air, as a result of which the pneumatic piston (16) is moved upward, that is, in the direction of the compression roll station (1). As a result of this upward movement of the pneumatic piston (16) the actuating rod (13) is pushed into the inner piston (8) of the holding device (21). The top of the pneumatic cylinder (33) makes contact here with the bottom (32) of the holding device (21). As a result of the upward movement of the pneumatic cylinder (16) and the shifting of the actuating rod (13) which this brings about into the inner piston (8) of the hydraulic cylinder (3), the free space (26) in the upper area of the holding device is reduced. As a result of the upward movement of the actuating rod (13), the lower area (13 *b*) of the actuating rod (13) is now at the level of the pressure pins (12). This lower area (13 *b*) has a smaller diameter than the upper area (13 *a*) of the actuating rod (13), as a result of which there is now no more contact between the pressure pins (12) and the actuating rod (13). The pressure pins (12) are therefore now free in their movement; however, the circumferential spring (11) cannot yet press the locking elements (10) inward and therefore reduce the diameter of the locking unit (37) since the locking elements (10) are still firmly pressed against the clamping collar (24) by the plate spring packet (7). The plate spring packet (7) draws the locking unit (37) here against the bottom of the compression roll station (1) and also draws the locking elements (10) against the clamping collar (24).

FIG. 4 shows the side view of a preferred embodiment of the holding device (21) of the invention in the so-called loosened state. In order to loosen the locking elements (10), the chamber (25) is loaded with oil pressure via the hydraulic connection (18) for activating the outer piston (9). As a result of this oil pressure the plate spring packet (7) is pressed downward by the outer piston (9), wherein this compact state of the plate spring packet (7) is designated as "on block". The compression of the plate spring packet (7) creates a free space (34) above the outer piston (9). The inner piston (8) follows the movement of the outer piston (9) due to the oil pressure parallel to the loading of the chamber (25) with oil pressure by the hydraulic connection (18), as a result of which the pneumatic piston (16) is simultaneously pressed down by the same amount since the pneumatic pressure is less than the hydraulic pressure. As a result of the slight downward movement of the inner piston (8) the locking elements (10) of the locking unit (37) are loosened from the clamping collar (24). As a consequence, the locking elements (10) can be drawn in by the tightened, circumferential ring spring (11) inward into the groove (27). The holding device (21) of the compression roll column (1) is now no longer tightened, that is, it is no longer in a spread position but rather in a loosened position. The compression roll station (1) can be rotated in this loosened position, for example, about its own axis (35) but cannot be shifted laterally manually since parts of the holding device (21) are still present inside the recess (22) of the carrier plate (2) of the rotary press. These components of the holding device (21) located in the recess and/or the piston bore (22) oppose the ability of the compression roll station (1) to be shifted manually.

FIG. 5 shows the side view of a preferred embodiment of the holding device (21) according to the invention in a rotor replacement position of the holding device (21). This is characterized in that now all components of the holding device (21) are located inside the compression roll station (1), as a result of which a decoupling of the compression roll station (1) from the carrier plate (2) becomes possible. To this end, at first the oil pressure on the hydraulic connection (18) is turned off. At the same time the air pressure on the pneumatic connection (19) is elevated, wherein the pneumatic piston (16) is moved upward and as a result the inner piston (8) of the hydraulic cylinder (3) is pushed with the support of the pressure spring (6) completely into the hydraulic cylinder (3). In the highest position of the pneumatic piston (16) inside the piston bore (22) there is an offset with an O-ring as seal (20). This offset moves in the highest position into the clamping collar (24) and therefore reliably closes the opening in the top of the carrier plate (2). The holding device (21) uses no energy in this rest position. The pneumatic piston (16) in the carrier plate (2) can remain loaded with a slight air pressure in order that the piston (16) does not drop down and the sealing function of the O-ring remains preserved.

FIG. 6 shows the pneumatic cylinder (16) in the carrier plate (2) in a rest position. The pneumatic connection (19) is loaded by a slight excess pressure so that the pneumatic piston (16) does not drop down so that the sealing function of the O-ring (36) remains preserved. The fastening of the compression roll station (1) takes place practically in the inverse sequence to the one just described. After the compression roll station (1) has been precisely placed over a clamping position above a recess (22) of a carrier plate (2), the hydraulic connection (18) is loaded with pressure. As a result, the inner piston (8) drops down against the pressure of the pressure spring (6), wherein the pneumatic piston (16) is pressed downward in parallel until the inner piston (8) is seated by its stop on the outer piston (9). Subsequently, the oil pressure is raised in such a manner that the spring packet (7) is compressed, wherein a free space (34) is created and the inner piston (8) can move somewhat deeper into the bore (22) of the carrier plate (2). Then, the additional hydraulic connection (17) is loaded with oil pressure, as a result of which the actuating rod (13) is moved downward in the cylinder bottom (5) down to its stop. As a result of the tapering of the actuating rod (13) in a transitional area between an upper area (13 *a*) and a lower area (13 *b*) of the actuating rod (13), the latter presses the pressure pins (12,) and the locking elements (10) connected to them outward during the downward movement until the locking movement (37) has reached its maximum diameter and the locking elements (10) rest on the inner wall (31) of the recess (22). The oil pressure on the hydraulic connections (17, 18) is now turned off. As a consequence, the plate spring packet (7) is relaxed and draws the locking elements (10) by the inner piston (8) against the shoulder of the clamping collar (24). This achieves a stable fastening of the compression roll station (1) inside the recess (22) of the carrier plate (2).

LIST OF REFERENCE NUMERALS

1 compression roll station
2 carrier plate
3 hydraulic cylinder
4 cylinder top
5 cylinder bottom
6 pressure spring
7 plate spring packet
8 inner piston
9 outer piston
10 locking elements
11 circumferential ring spring
12 pressure pins
13 actuating rod
13*a* upper area of the actuating rod
13*b* lower area of the actuating rod
14 pneumatic cylinder
15 sealing sleeve
16 pneumatic piston
17 hydraulic connection P1
18 hydraulic connection P2
19 Pneumatic connection P3
20 seals
21 holding device
22 piston bore or recess
23 compressed air chamber
24 clamping collar
25 hydraulic chamber for outer piston (9)
26 hydraulic chamber for outer piston (9) or for actuating rod (13)
27 groove
28 upper pressure roll
29 lower pressure roll
30 free space inside the recess (22) between holding device (21) and Pneumatic piston (16)
31 inner wall of recess (22)
32 lower closure of the holding device (21)
33 top of the pneumatic piston (16)
34 free space produced by compressing the plate spring packet (7)

35 central axis of the holding device (21)
36 O-ring
37 locking unit

The invention claimed is:

1. A rotary press, in particular for producing tablets, the rotary press comprising:

at least one compression roll station configured to receive compression rolls, the compression roll station including a holding device located at least partially inside the compression roll station, wherein the compression roll station is detachable from the rotary press and has a columnar construction; and a carrier plate including recesses configured to receive the holding device of the compression roll station, the holding device being configured to fix the compression roll station in the recesses of the carrier plate;

wherein the holding device comprises locking elements which form in their entirety an annular locking unit with a variable diameter.

2. The rotary press according to claim 1, wherein the locking unit is designed to be adjustable in height, the holding device including an actuating rod which is arranged in the middle of the annular locking unit, the actuating rod configured to adjust the height of the locking unit.

3. The rotary press according to claim 2, wherein the actuating rod has a diameter which tapers in the lower area of the actuating rod.

4. The rotary press according to claim 2, wherein the diameter of the locking unit is maximum in a first position and minimum in a second position, wherein the diameter can be varied by the actuating rod.

5. The rotary press according to claim 4, wherein the locking elements of the locking unit are pressed in the first position onto an inner wall of the recess of the carrier plate.

6. The rotary press according to claim 4, wherein the diameter of the locking unit in the second position is smaller than the diameter of the recess of the carrier plate.

7. The rotary press according to claim 4, wherein the holding device is located completely inside the compression roll station in a third position.

8. The rotary press according to claim 4, wherein the compression roll station is configured to be shifted as well as pivoted on the carrier plate of the rotary press in the third position.

9. The rotary press according to claim 2, wherein the actuating rod is movable hydraulically, pneumatically, mechanically and/or electromechanically.

* * * * *